United States Patent [19]

Baker

[11] Patent Number: 4,754,845

[45] Date of Patent: Jul. 5, 1988

[54] STEP LADDER

[76] Inventor: William H. Baker, 204 Buena Vista Dr., Long Beach, Miss. 39560

[21] Appl. No.: 113,900

[22] Filed: Oct. 29, 1987

Related U.S. Application Data

[63] Continuation-in-part of Ser. No. 11,693, Feb. 6, 1987, abandoned.

[51] Int. Cl.[4] ..... E06C 1/28

[52] U.S. Cl. ..... 182/170; 182/173

[58] Field of Search ..... 182/165, 169, 170, 173, 182/174, 175

[56] References Cited

U.S. PATENT DOCUMENTS

| | | | |
|---|---|---|---|
| 124,518 | 3/1872 | Sweet | 182/173 |
| 947,409 | 1/1910 | Hudson | 182/165 |
| 1,778,898 | 10/1930 | Konigsberg | 182/170 |
| 2,650,014 | 8/1953 | Harrison | 182/170 |

*Primary Examiner*—Reinaldo P. Machado

*Attorney, Agent, or Firm*—Alexander F. Norcross

[57] ABSTRACT

A step ladder is shown, having a rigidified step section, a strengthened upper platform, two independently articulated angled rear legs, supported by a pair of rigid, pivoting supports. The angle of extension of the rear legs creates, in conjunction with the front step section of the step ladder, an essentially equilateral, triangular footprint of increased stability. The individual legs, in cooperation with a strengthened, rigid top plate structure, and the single member rigid support strut produces a decreased likelihood that the ladder will "walk" or move under the shifting weight of a user. The triangular footprint creates increased static stability, and also reduces the likelihood of toppling as a result of movement of a person standing on or near the upper step. The support leg actuation linkage is vertically fixed along a linkage support shaft. By fixing the linkage in three dimensions, torsional rigidity is maintained between the independent legs and walking motion is eliminated.

3 Claims, 4 Drawing Sheets

STEP LADDER

RELATED APPLICATIONS

This is a continuation-in-part of my co-pending application Ser. No. 07/011,693, filed 02/06/87, now abandoned, which is incorporated herein by reference.

BACKGROUND OF THE INVENTION

The current invention relates to the field of step ladders, and to the design of step ladders to permit a folding structure to be used as a self-supporting, or free-standing ladder, while maintaining an adequate degree of stability to prevent over-tipping and dangerous falls.

Step ladders provided a means for an individual to climb to a height for manipulating objects or performing work where the ladder is essentially free-standing; that is, the ladder depends solely upon its construction and erection to insure its stability, in comparison to standard extension ladders which are braced against a structure to be climbed.

A typical step ladder is designed to be folded into a convenient size for storage and carrying, and the requirement that it be portable is a further constraint, restricting the total weight of the ladder. Thus, a typical step ladder will be found to weigh thirty pounds or less weight, in order to insure that it may be easily handled, and it is typically designed to be folded into an essentially flat package of not much increased size over a fixed ladder of similar size.

The classic step ladder has a front ladder portion having two vertically ascending parallel members with angled steps periodically interposed between to permit climbing. At an upper end a rear leg section is pivotally attached, and a folding brace member is used to extend the ladder into an expanded, climbable configuration. The front and rear leg members and the cross-brace form the classic letter "A" in the extended position.

The stability of such a ladder is totally dependent upon the user's movement upon the ladder during use. The requirement that the ladder be portable tends to reduce the static weight of the ladder to as low a level as is consistent with minimum structural strength, and it will typically be found that such a step ladder will weigh under thirty pounds; when considering that a typical user will weigh one hundred and fifty pounds or more, this implies that in use practically all the weight involved in the dynamic couple of step ladder and user will be concentrated in the user and that there will be very little static weight tending to stabilize the ladder.

Thus, two forces degrade the stability of the ladder and create dangerous toppling propensities. The first is static stability; that is, the fact that the ladder will unconditionally fall if a line, extending downward from the combined center of gravity of the user and ladder, extends to a point outside the area demarked by the legs of the ladder. This is the classic condition of static instability and results inevitably in toppling. Because the ladder has such little weight relative to the user the actual location of the center of gravity of the user predetermines the stability. A typical individual's center of gravity is located approximately at the belt line, and prior art ladders have concentrated in maintaining stability by providing extensible retaining rails so as to by physical restriction or by suggestion and feel restrain the user from leaning excessively over the side of the ladder, producing an unstable condition.

A second, dynamic condition of instability exists because a user at the top of the ladder, in normal motion, is exerting a reactive force across a moment couple essentially equal to the distance from the foot of the ladder to the point of contact with the user; this can often be a six foot moment couple. Since this is a dynamic condition, induced by the motions of the user during work, the resisting couple is that solely of the weight of the ladder itself, which is considerably less.

The dynamic motion coupled from the user's motion imposes two separate forces to the ladder. The first is asymmetrical side thrusts. To the extent that the force of the user's weight is projected along the force of gravity but off centered from the center of gravity of the ladder a differential vertical loading is established downward along the leg. Since the total of the downward gravitational component along the leg must equal the total combined weight of the user with load and the static weight of the ladder, it should be apparent that significantly increasing the side thrust loading along one leg can result in a significant decrease in the thrust loading along an opposite leg. This can be observed in wooden step ladders of relatively filmsy construction on an uneven surface as an actual lifting of one leg off the ground; it is quite naturally an alarming condition to the user and occurs immediately before overturning and toppling. Furthermore, since ladders involve at least one lattice structure of vertical legs and steps, such uneven loading produces actual sideways stress upon the bottom portion of the parallel legs where they touch the ground. It has been observed by testing agencies that when ladders of typical construction are tested for this condition that some ladders will actually bend and fall at the forced detachment point of the leg and the lowest step due to the side thrusts generated.

The motion of the user also creates a torsional stress, twisting the ladder. To the inventor's knowledge, this form of stress has not been recognized or discussed in the literature; nonetheless, it is the inventor's belief that torsional stresses, in the form of twisting about the vertical axis of the ladder, is the most common cause of dynamic unloading of one or more ladder legs in response to the user's motion. The result is an alternative loading and unloading of the legs of the ladder which produces an effect called "walking" where the ladder moves or creeps across the floor as the individual shifts his weight. Such a condition is indicative of marginal stability in the ladder, and can produce extremely dangerous situations.

The recognition of the problems referred to above as static stability have led to the various forms of wide base ladders, most typically having an approximate triangular effect as in Harrison, U.S. Pat. No. 2,650,014. Harrison recognized the increased stability to be achieved by widening the footprint of the ladder by independently articulating the two rear support legs.

However, these triangular ladders have been unsuccessful principally because the effects induced by dynamic instability, especially torsional instability, have not been allowed for. The active independently articulating rear support legs have removed the inter-leg bracing typical in the older "A" frame style ladders. Of necessity, each of the individual rear support legs is a columnar structure or tubular structure of relatively restricted mass in order to provide a feasible ladder of suitably light weight. Each of these prior art structures has utilized some form of folding bracing to brace the legs individually against each other and against the front of the ladder. However, such folding bracing, whether that is shown in Harrison or in an earlier patent to Konigsberg, U.S. Pat. No. 1,778,898, has proven unsatisfactory in achieving adequate rigidity within the triangular ladder structure.

The current invention also recognizes the inherent safety hazard posed by the side braces on the older "A" frame ladders, and the lack of a positive locking mechanism for securing the legs of the ladder when open or closed.

SUMMARY OF THE INVENTION

The current invention discloses a step ladder of innovative design in which stability is enhanced by providing, in lieu of the standard paired, parallel rear legs, two individually extensible rear legs, coordinated by extension braces, and installed so that upon extension they form an expanding triangular footprint of increased stability in comparison to the rectangular footprint of a classic step ladder.

In addition, the individual rear legs are braced with a unique rigidified truss brace having a rigid cross-section and having means for fixation in the vertical plane, the legs are hinged with relatively wide torque resistant hinges to a rigid top plate from which descend fixed, vertical brace support which provides a point of leg brace fixation nearly in line with the center of gravity of the ladder. This novel brace significantly decreases bending moment and movement possible within the legs and braces.

The result is an extremely rigid structure having a wide base footprint and a significantly decreased susceptibility to both static instability and to walking effects. The angles of extension of the rear legs produce a ladder which has a reduced tendency to walk as the user mounts to a higher step, due to the increased motion required of the user to produce an unloading effect on the triangularly extended legs.

It is thus an object of this invention to produce a free-standing ladder, adapted for climbing, having a significantly reduced tendency to fall or tip for a given ladder size and weight and for a given user.

It is a further object of this invention to show a design of a step ladder having a significantly reduced tendency to walk or move under usage in comparison with ladders of the prior art.

It is a further object of this invention to describe a ladder of significantly increased rigidity and strength when in comparison to ladders of the prior art.

It is a further object of this invention to provide a safe, secure, and simple method of extending and retracting the rear legs of the ladder with positive locking in both positions, and controlled entirely from the front of the ladder.

These and other objects of the invention can be more clearly seen and understood from the detailed description of the preferred embodiment which follows.

DETAILED DESCRIPTION OF THE PREFERRED EMBODIMENT

Figure 2:
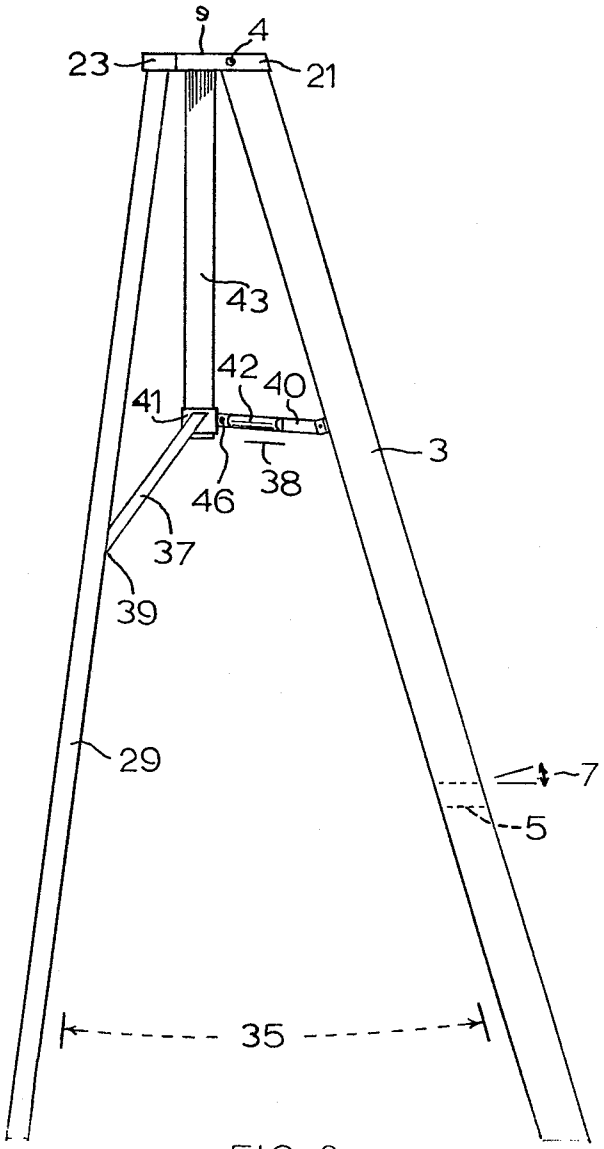
FIG. 2 is a side view of the ladder of the current invention.
Figure 1:
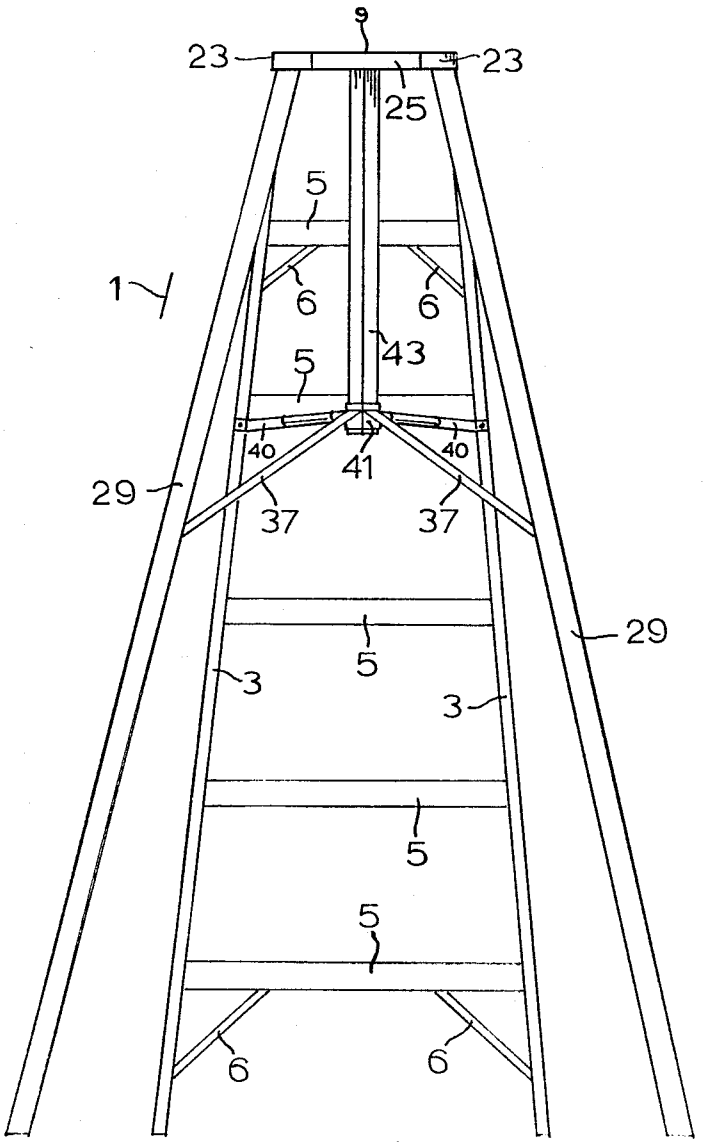
FIG. 1 is a rear view of an extended ladder of the invention.
Figure 3:
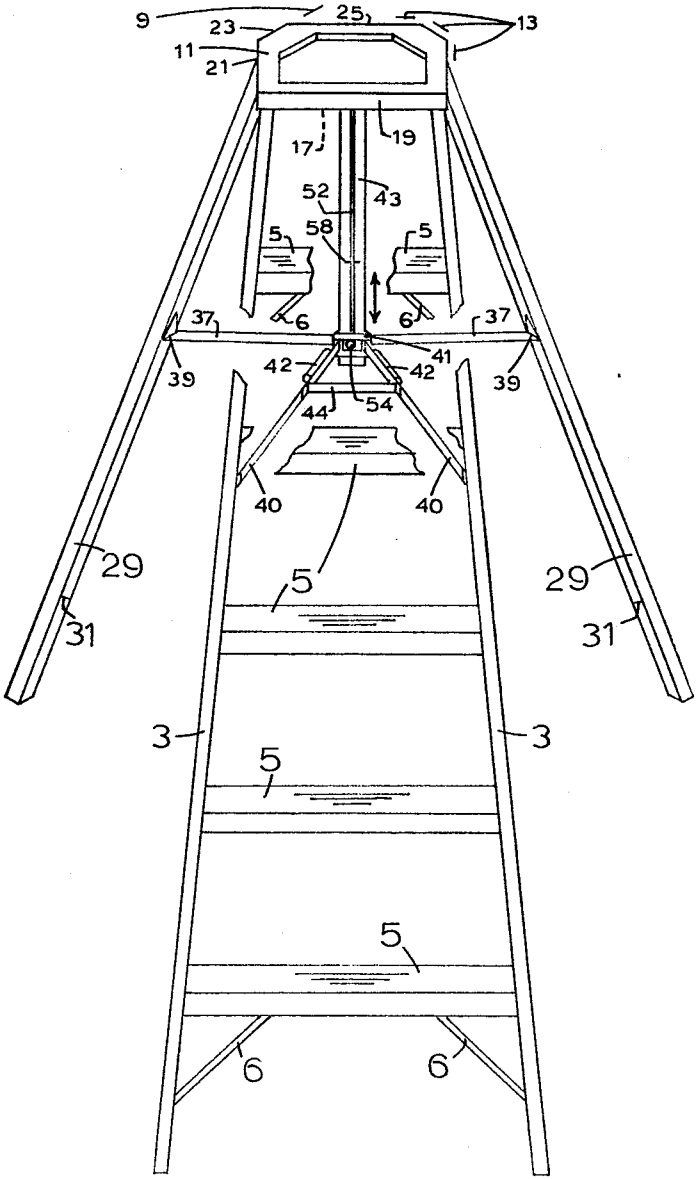
FIG. 3 is a front perspective extended view of the ladder of the current invention.
Figure 4:
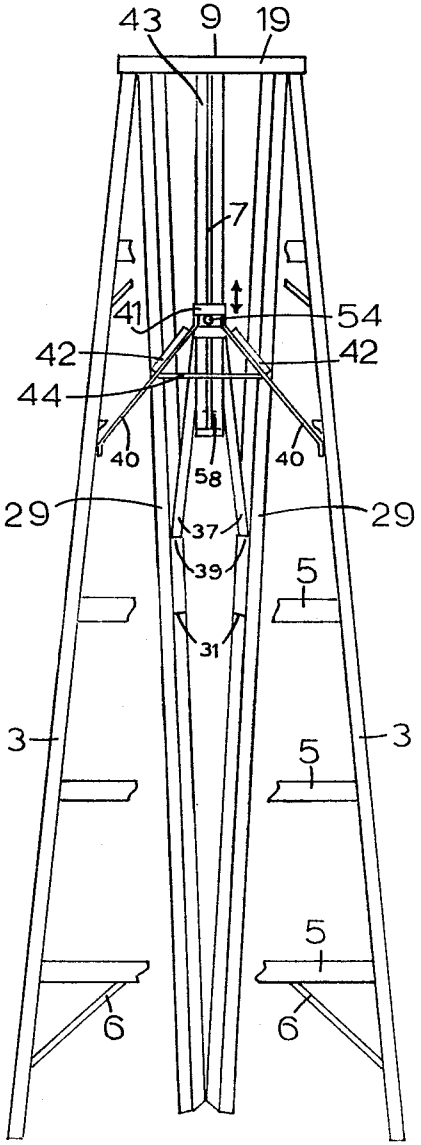
FIG. 4 is a front view with legs retracted with cut away section showing the current invention.
Figure 5:
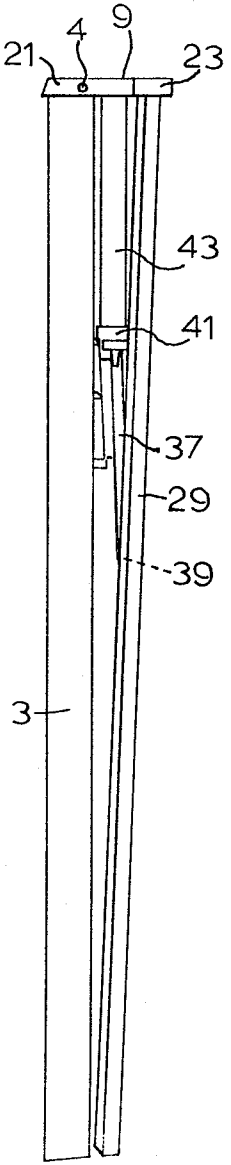
FIG. 5 is a side view showing the legs retracted.

Referring to FIGS. 1 through 2, the ladder 1 is seen to comprise in a front section, twin parallel ascending vertical leg supports 3, in the preferred embodiment constructed of a rigid channel material such as a u-shaped aluminum channel. At evenly spaced intervals, horizontally but angularly installed upon vertical leg supports 3 are steps 5, again preferably of a rigidified channel member capable of supporting the weight of a user and fastened rigidly to the vertical leg supports by welding, riveting or the like as is well understood in the art.

Each of steps 5 is angled with respect to the long side of support 3 at step angle 7 which is adapted so that when vertical leg supports 3 are extended in an erect configuration, as is typified in FIG. 2, steps 5 are essentially horizontal.

Periodically, but generally at least every other step, are found corner reinforcements 6 which are fixably installed at and below the points of attachment of steps 5 and vertical leg supports 3 as standard corner braces. Such corner attachments 6 may be riveted or preferably welded along a distance on step 5 and also along a distance on vertical support 3 so as to strengthen the joint of steps 5 and vertical supports 3 against folding pressures and twisting moments.

Each vertical leg support 3 is attached to rigid top plate 9; the affixation is by a pivoting connection 4, to said top plate.

Rigid top plate 9 is in a preferred embodiment of the invention an essentially thick metallic plate having a reenforcing ridge 11 extending around its outer periphery 13 and enclosing a working table, adapted for the placement and retention of tools and the like. In addition, a reenforcing ridge 11 terminates in an outer channel 17, folded over so as to create a strong and rigid structure not easily bent or warped under the loads and forces exerted by the standing weight of a typical user.

Top plate 9 is in cross-section an essentially half hexagonal structure, resembling a truncated hexagon extending from a front edge 19 along two essentially parallel side edges 21 each to two angularly convergent side leg support edges 23, the far ends of which are then interconnected through affixed back edge 25.

Leg support edges 23 are angled with respect to side edges 21 so as to produce an angle of extension 27 of back legs 29, as will be hereinafter described. Pivotally connected to top plate 9, extending outwardly, perpendicular to support edges 23, are two back legs 29. Each of back legs 29 is connected to support edge 23 through an elongated hinge not shown, such as a roller hinge, piano hinge, butt plate or a pin and sheath hinge, as are well understood in the art.

Leg 29 is preferably constructed in a rigidified form of an essentially wide Box-shaped channel, and may alternatively be formed of an I-beam or tubular shape; in either case having a cross-channel braced construction with a web 31 thereof being parallel to support edge 23 ending in a pair of channel extensions forming hinge attach points for the leg hinge. As a result, any twisting torque or torsional forces upon back legs 29 are not coupled to a narrow hinge but rather are coupled through a hinge essentially as wide as that of the entire web 31, coupled into two physically separated points along support edge 23.

At a point 39 approximately mid-length of each back leg 29, and pivotally connected thereto, at a point 39 adapted to create an appropriate opening angle 35 of the ladder 1, are pivotally mounted support braces 37.

In contradistinction to the prior art, support braces 37 are not hinged or broken but are a single rigid structure, preferably of a channelized construction, having a web and cross-braces or of a truncated box shape so as to be relatively free from bending under the forces encountered in the use of the ladder. Support brace 37 extends from fixed pivoting attach point 39 upon back leg 29 to sliding coupler 41. Sliding coupler 41 is a restrained captive sliding hinge coupler, slidingly affixed to a support slide 43.

Further attached to sliding coupler 41, through a pivoting attachment and extending forward to a point of pivotal attachment to vertical leg supports 3 is front brace assembly 38. Front base assembly 38 is a reenforced, essentially triangular braced assembly consisting of two handle arms 40, each of which is pivotally affixed at one end to sliding coupler 41, and pivotally affixed at the second end to one of the two vertical support legs 3; the result is that each of the vertical support legs 3 are pivotally affixed through a handle arm 42 sliding coupler 41. A cross brace member 44 is fixedly attached between a mid-point of one handle arm 40 to a circuit mid-point of handle arm 40 forming a reenforcing triangular brace section. Substantially at the point of attachment of cross brace 44 to each of handle arm 40 are found handlebars 42; in the preferred embodiment these are smooth shaped wooden bars adapted to permit a user to readily grasp the handle arm 40 for manipulation. The handlebars 42 are further located sufficiently closely to sliding coupler 41 that an individual holding onto the handlebar might conveniently reach sliding coupler 41 with a thumb.

Figure 6:
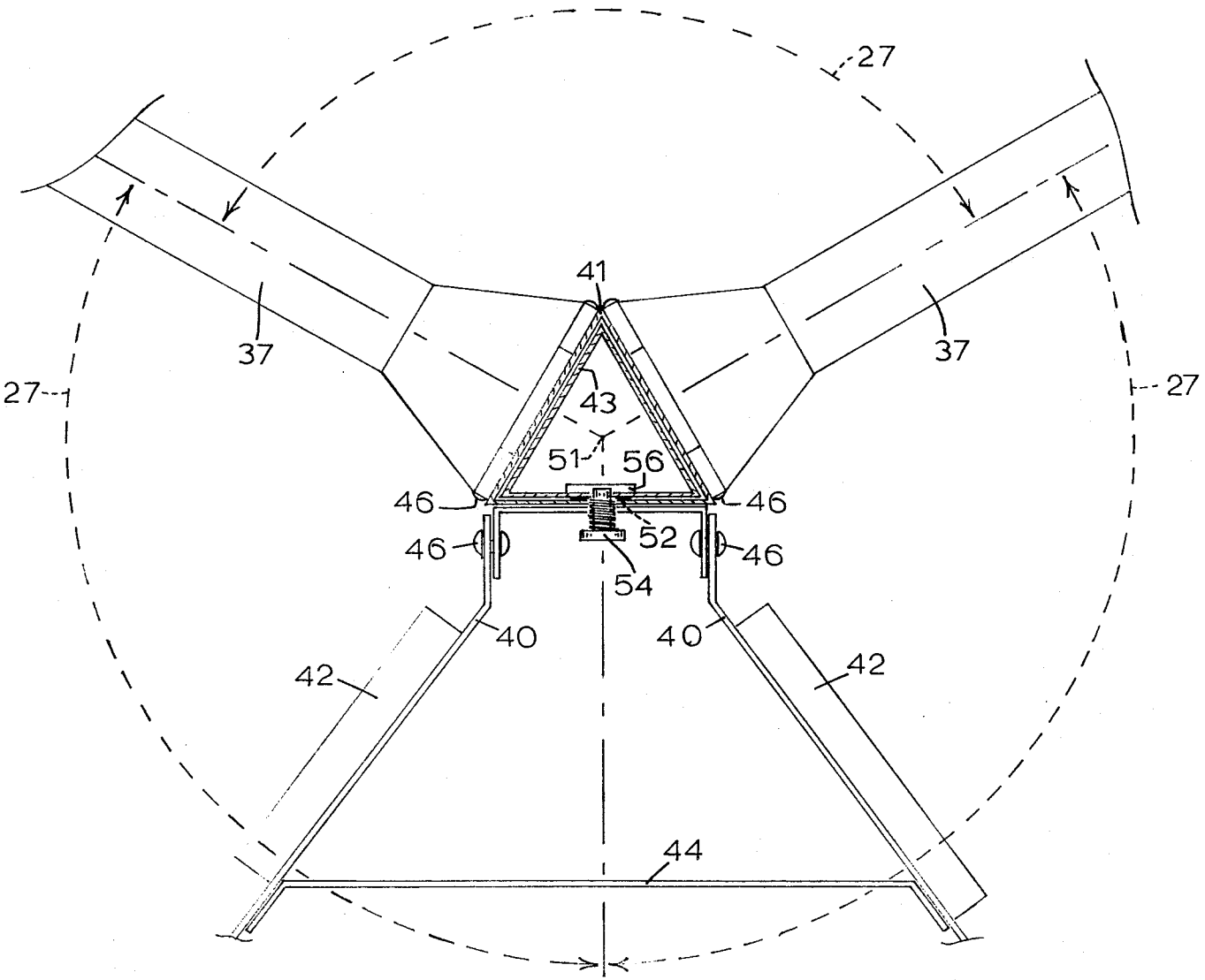
FIG. 6 is an alternate lower step section showing a method of rigidifying the step structure.
Figure 7:
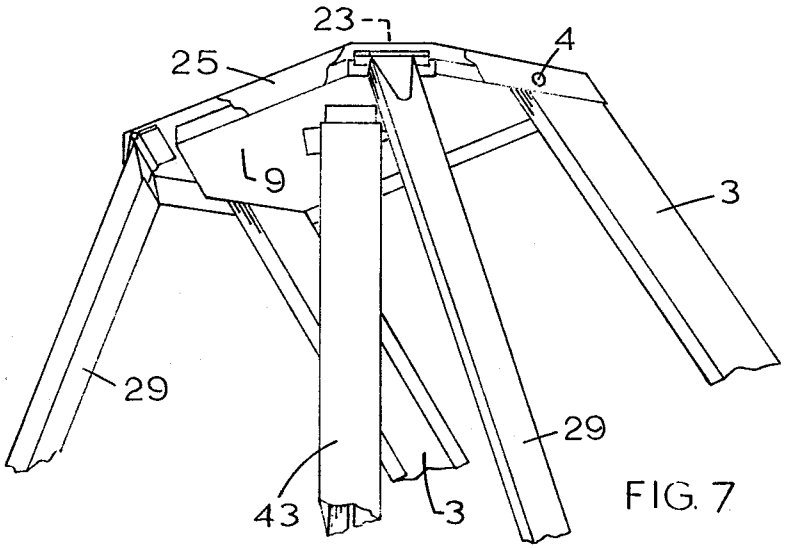
FIG. 7 is a three-quarter rear perspective view showing attachment of structural members to underside of top plate.
Figure 9:
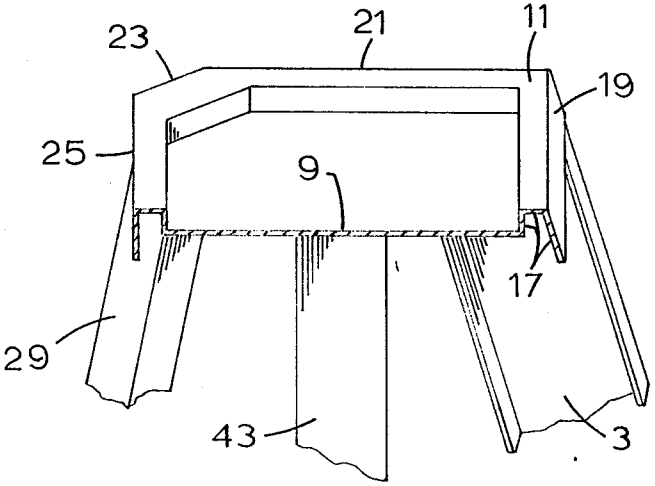
FIG. 9 is an overhead view showing cross-section of top plate configuration.
Figure 8:
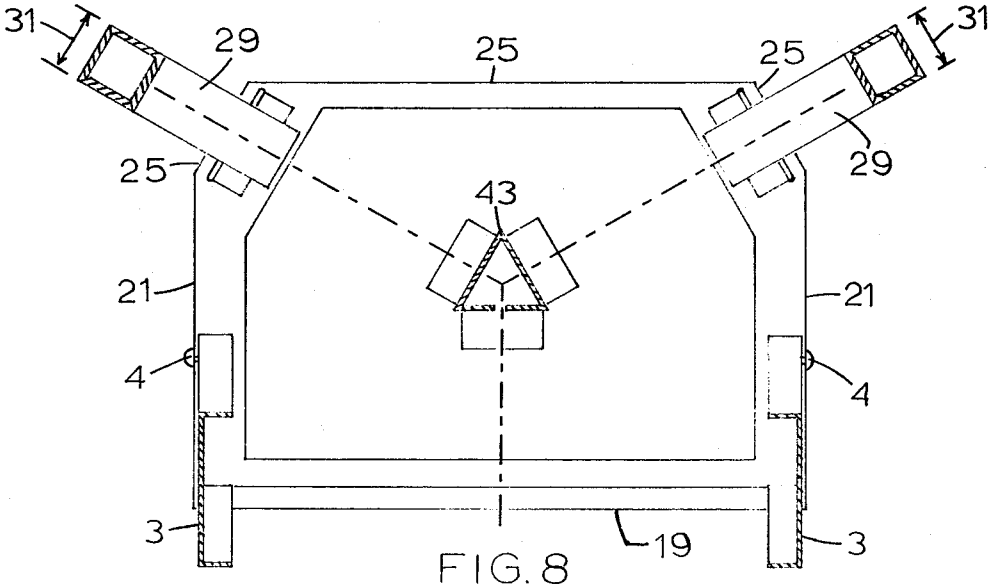
FIG. 8 is a bottom view of top plate showing attachment of structural members.

Sliding coupler 41, is, as previously stated, sliding affixed to vertical support slide 43. Vertical support slide 43 is a rigid substantially strong structure structurally affixed, preferably by welding perpendicular to top plate 9 and extending vertically downward therefrom. In the preferred embodiment support slide 43 is a substantial triangular extrusion 51 most clearly shown in FIG. 6. Triangular extrusion 51 is chosen such that perpendiculars drawn from each of the three triangular faces form angles identical to and equal to rear leg extension angle 27. Within support slide 43, on the face most adjacent to steps 5 of the ladder is provided an open vertical slot 52.

Sliding coupler 41 is formed of a unitary triangular structure mated to and slidingly enclosing support slide 43. The triangular structure defining thereby three surface faces, each of the faces has affixedly attached a pivoting coupler pivot point 46; two of the coupler pivot points 46 are the point of pivoting connection of each of the two support braces 37 with the two back legs 29. On the side of sliding coupler 41 corresponding to that face of support slide 43 within which exists slot 52, coupler pivot 46 is a split coupler, pivotally interconnecting handle arms 40 with sliding coupler 41, but permitting open access to coupler actuator 54.

In the preferred embodiment of the invention coupler actuator 54 is a spring loaded, thumb activated push button, captured in and passing through sliding coupler 41 and riding within support slide slot 52. Within the interior of support slide 43, actuator button 54 is provided with slide gripping means 56. Slide gripping means 56 are designed so as to provide a fixed engagement at certain vertical positions along support slide slot 52. In the preferred embodiment of the invention the fixed engagement is created by providing, along support slide 43, at positions corresponding to desired extensions of the step ladder 1, locking notches 58 perpendicular to slide opening 52. A corresponding extrusion on support slide locking member 56 mates with locking notches 58 so as to secure sliding coupler 41 against vertical motion unless it is unlocked by depressing button 54.

In operation handles 42 are grasped and fastening means 54 is depressed, releasing sliding coupler 41 for movement to a lower position along support slide 43. Sliding coupler 41 is latched into a locking position by interlocking notches 58 and latch 56. When so locked, sliding coupler 41 forms a central point creating a rigid interconnection through support braces 37 to back legs 29, through handle arms 40 to front legs vertical supports 3, and to top plate 6 through vertical support slide 43. The geometry of the interconnection is such that leg extension angles 27 are maintained, forming a substantially equilateral base for support of the ladder, and maintain through the rigid structure comprising top plate 9 and vertical support slide 43 a three-dimensional support truss structure supporting each of the independent back legs 29. It is believed that it is this third dimensional support created by the rigid interconnection of vertical slide 43 and top plate 9 which provides the substantial rigidity against both torsion and side load through the otherwise unsupported back legs 29.

The strength of the truss structure is enhanced by insuring that both at brace pivots 46 and at the pivotal attachment of rear legs 29 to top plate 9 that the hinge points are substantially wide rather than being plate hinges or single bearing hinges and thus the hinge points are substantially resistant to relative torsional motion across the hinge. While it should be noted that the hinge points 46 for handle arms 40 are shown as individual point pivots, the torsion resisting effect is created by having two such front hinge points 46, separated by the width of sliding coupler 41, and by further interconnecting the handle arms 40 by cross brace 44 to provide the torsion resistant structure.

As previously mentioned the angle of support leg edges 23 is such that in fully extended position, the bottom feet 55 of each of back legs 29 form adjacent vertices of an essentially equilateral triangle, the third vertex of which is located at an imaginary point midway between bottom feet 57 of vertical leg supports 3. For a six foot step ladder it has been found that this means that the relative angle of support leg edges 23 with respect to each other is approximately 120°.

An individual ascending the step ladder 1 will find that the truss rigidified triangular base configuration thereby created produces essentially constant stability as the individual ascends or descends the various steps 5, in contradistinction to the situation of the typical step ladder in which the relative size of the footprint projection becomes angularly smaller as the individual ascends and therefore the stability of the step ladder is decreased. The triangular footprint created by the structure disclosed creates increased static stability inasmuch as an ascending individual gradually rises to a point directly over the center of a triangular footprint structure, and that individual's center of gravity is essentially equidistant from any of the imaginary lines extending from one foot to adjacent foot of the ladder, these lines marking the demarkation between static stability and static instability.

In addition the rigidified truss structure disclosed and the three-dimensional rigid fixation between each of the legs and the top plate significantly reduces the force moment produced by the movement of the individual on the upper steps and thus significantly increases dynamic stability. In particular, in order to walk any of the legs, dynamically moving the ladder, the individual must move so as to create a reaction force on the ladder which acts to unload a leg by changing the angular relationship between the legs; by providing a three-dimensional truss brace, susceptibility of the ladder to this effect is minimized.

It is critical in this regard that the individual braces are fixed to resist both compression or tension loads, either of which may be independently created dependent upon the position and motion of the user on the ladder. It is for this reason that chains or loose hooks, sometimes used in the prior art, have proven unsatisfactory in maintaining the rigidity of the ladder against torsional forces in walking; neither a chain nor an engaged hook provides any substantial resistance to compressive forces, which tend to collapse the chain or disengage the hook. Such compressive forces also react against the prior art over center latches which have almost universally been used in previous ladders, the effects of which are overcome by the fixation in a third, vertical dimension provided by the particular geometry of slide support 43.

Thus for an equal weight of ladder and user, the structure disclosed in the instant invention is increasingly resistant to dynamic instability as opposed to the step ladders of the prior art.

It should be understood that the above is a description of a particular embodiment of the ladder, adapted for creation in metal, as is evident from the description of the extrusions and channels used. The construction of such a ladder in alternate materials or in alternate forms would be readily apparent to those skilled in the art.

Thus the invention encompasses not only the specific embodiment disclosed above but that wider range of equivalents as claimed.

I claim:

1. A step ladder comprising:

an angled, vertically extending front step section means;

a deflection resisting top plate means pivotally affixed to an upper end of the step section means;

a first and a second rear support leg pivotally attached to said plate means;

said first and said second rear support legs extending at a substantially acute angle from each other and from said front step section means;

a column fixedly attached to said plate means, descending vertically therefrom;

sliding collar means, slidably affixed to said vertical descending column for positioning along said vertical column;

rigid support means, pivotally affixed at a first end to said sliding collar and at a second end to said front step section means; and rigid support means pivotally affixed at first end to said sliding collar and at a second end to each said rear leg.

2. In a step ladder of the type having individually extensible legs producing an essentially triangular footprint and means for bracing the rear legs in the extended position, the improvement comprising:

said brace comprising a first substantially rigid support shaft means extending vertically from a point at the apex of said ladder in a downward direction;

rigid brace bars, pivotally affixed at a first end thereof to a mid-point point of each leg of said ladder;

the second end of each leg brace being pivotally affixed to a collar means slidably engaging said first support shaft;

means for affixing said collar means at at least one point along said brace.

3. The apparatus of claim 2 wherein:

said support shaft is a generally triangular extrusion having braces substantially perpendicular to the direction of extension of said legs;

each said leg is pivotably fastened to extend in a single, linear direction from a center point to a triangular vertex; and each said brace is pivotally affixed at the ends thereof by hinge means substantially resistant to torsional motion.

* * * * *